US006192721B1

(12) United States Patent
Monteleone

(10) Patent No.: US 6,192,721 B1
(45) Date of Patent: Feb. 27, 2001

(54) LOCK PROTECTOR

(76) Inventor: Louis Monteleone, 19 Wildwood Rd., Hartsdale, NY (US) 10530

( * ) Notice: Subject to any disclaimer, the term of this patent is extended or adjusted under 35 U.S.C. 154(b) by 327 days.

(21) Appl. No.: 08/686,337

(22) Filed: Jul. 25, 1996

(51) Int. Cl.[7] ..... E05G 67/38
(52) U.S. Cl. ..... 70/55; 70/56; 70/DIG. 56
(58) Field of Search ..... 70/55, 455, 56, 70/DIG. 56

(56) References Cited

U.S. PATENT DOCUMENTS 858,264 6/1907 Daugherty .
1,581,953 4/1926 Jackson .
4,651,543 3/1987 Heald et al. .
5,003,795 4/1991 Hoke .

*Primary Examiner*—Teri Pham
(74) *Attorney, Agent, or Firm*—Gottlieb, Rackman & Reisman, P.C.

(57) ABSTRACT

A protector for a padlock of the kind having a body and a shackle, said protector having a pouch for holding the body and a flap for forming a closed pocket with said pouch, with the shackle extending out of the pocket. In this manner the shackle is free to rotate so that it can engage a chain link, a hasp, and so on. The protector is preferably made of flexible material such as rubber.

10 Claims, 2 Drawing Sheets

LOCK PROTECTOR

BACKGROUND OF THE INVENTION a. Field of Invention

This invention pertains to an ease to use, economical protector for locks, and more particularly, for a protector for use with a lock having a body and a generally U-shaped shackle. The protector is particularly effective against the elements.

b. Description of the Prior Art

Locks are used universally to protect various types of personal property or to control access to certain physical locations. Often these locks are exposed to the elements and may be adversely affected by them. An extreme example is the use of padlocks on trucks. Truck drivers use routinely several padlocks mounted for example on the rear to protect their cargo from vandalism. As a result, the padlocks are exposed to rain, snow sleet, mud and all the materials found on roads. Frequently, because of this exposure, locks freeze up and the only way they can be removed is by breaking them. Of course, once broken, they cannot be reused, and the driver must buy another padlock or carry spares.

There were several attempts to solve this problem by providing lock protectors. One such protector is disclosed in U.S. Pat. No. 5,003,795. However this protector is disposed about the whole lock and the hasp of a mail box is engaged by the lock. The only way this protector can be used is by mounting it on the hasp before the lock is installed. Thus the protector cannot be used in applications without hasps, or where two or even more elements are connected to by or coupled to a lock. Moreover this protector is difficult and time consuming to use.

Another protector is disclosed by U.S. Pat. No. 4,651,543. This is a two part protector molded to conform to a particular lock and hence cannot be used for a different lock. A further disadvantage of this protector is that it has several openings, which permit foreign material to enter the lock and hence does not provide adequate protection. Moreover the molded protector is difficult and expensive to manufacture.

Other lock accessories are disclosed in U.S. Pat. No. 858,264 and 1,581,953.

OBJECTIVES AND ADVANTAGES OF THE INVENTION.

In view of the above-described disadvantages of the prior art, it is an objective of the present invention to provide a lock protector which is mounted securely and substantially hermetically about a lock for protection.

A further objective is to provide a protector which is easy to use even in the most inclement weather.

Yet another objective is to provide a lock protector which can be made of a cheap, recycled materials. Other objectives and advantages of the invention shall become apparent form the following description of the invention.

Briefly, a lock protector constructed in accordance with this invention comprises a sheet of a flexible material and having two opposed edges, the sheet being folded over itself and the edges joined together to form a pouch and a flap joined to a wall of the pouch along a fold line. Means are provided to secure the fold to an outer wall of the pouch to form a substantially hermetically closed pocket. The sheet is provided with one or more apertures along the fold line. The aperture is arranged to receive the shackle of a lock before and after it has been passed through a hasp or other hoop or link.

A lock protector constructed in accordance with this invention provides the following advantages:

(a) It protects locks from freezing as well as from rain, salt, sand, and prevents the same from interfering with the lock mechanism.

(b) It extends the useful life of the locks.

(c) It can be made from recycled products and does not require any processes which pollute the environment.

DETAILED DESCRIPTION OF THE INVENTION

Figure 1:
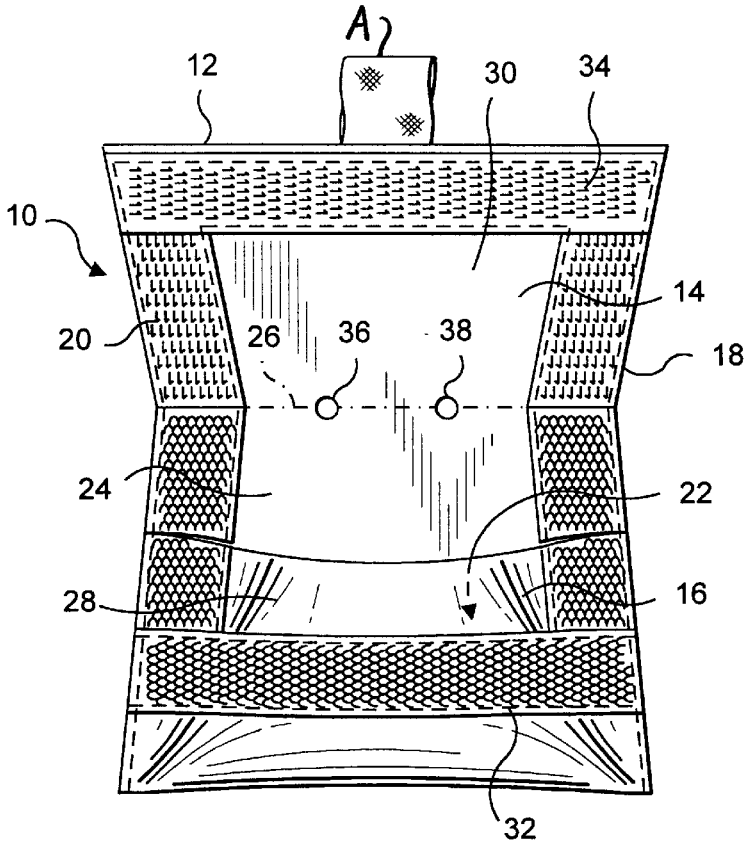
FIG. 1 shows a plan view of a protector constructed in accordance with this invention.
Figure 2:
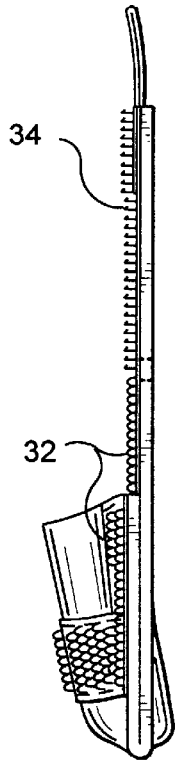
FIG. 2 shows a side view of the protector of FIG. 1.

Referring now to FIGS. 1 and 2, a lock protector 10 constructed in accordance this invention consists of a sheet 12 having a lower portion 16 and an upper portion or flap 14 and two lateral edges 18, 20. A tab A extends away from the flap 14 as shown and is made of the same material as the flap 14. The tab A is secured to the flap 14 preferably by sewing. The lower portion 16 has been folded over itself to form a pouch 22. For this purpose the edges 18, 20 extending along the lower portion are joined by gluing, sewing, stapling or other adhesive or mechanical means dependent on the material of the sheet 12. The pouch 22 thus formed has a back wall 24 joined to the flap 14 by an imaginary fold line 26.

Pouch 22 also has an outer surface 28 and the flap 14 has an opposing surface 30. Surfaces 28, 30 have complementary securing means for securing these surfaces to each other. For example, as shown in FIG. 1, these two surfaces may be provided with a plurality of VELCRO® strips 32, 34. Obviously other means of interlocking or engaging the flap to the pocket may be used. These strips 32, 34 cooperate so that when the flap 14 is folded along line 26 and the strips 32 and 34 are interlocked or otherwise engaged thereby closing the pouch 22 and forming a substantially hermetically closed pocket As shown in FIG. 1, the edges 18, 20 are generally v-shaped so that sheet tapers slightly inwardly toward the fold line 26 to form a natural pocket which holds the lock when it is inserted into the protector as described below. Importantly, the sheet 10 is formed with two round apertures 36, 38 disposed on the fold line 26 as shown.

Figure 3:
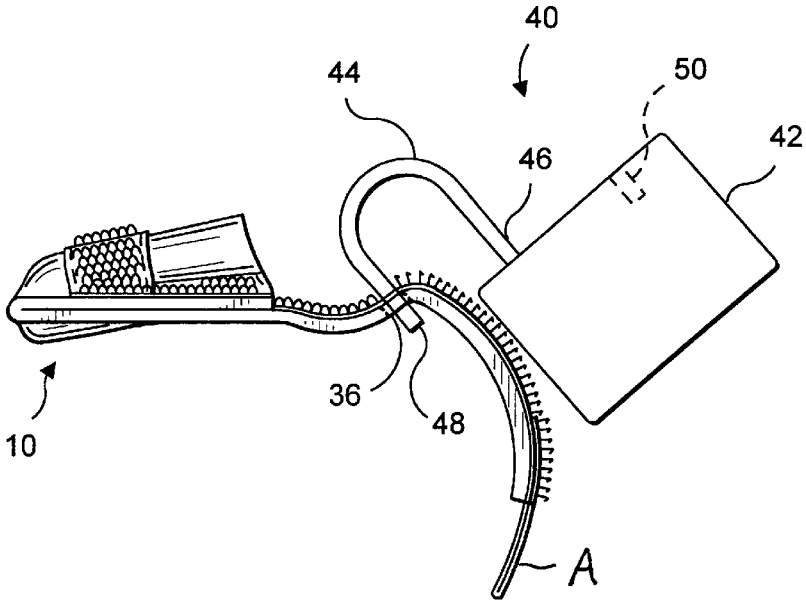
FIG. 3 shows how the shackle of a lock is inserted into the protector of FIGS. 1 and 2.

Referring to FIG. 3, the protector is used as follows. A typical lock 40 has a body 42 and a shackle 44. The shackle 44 is generally Ushaped and has two opposing legs 46 and 48. Leg 46 is rotatably attached to the body 42. Body 42 has a well 50 for accepting and mechanically locking leg 48. The lock 40 may be opened by a key inserted into a hole (not shown for the sake of clarity) or it may be combination lock.

Figure 4:
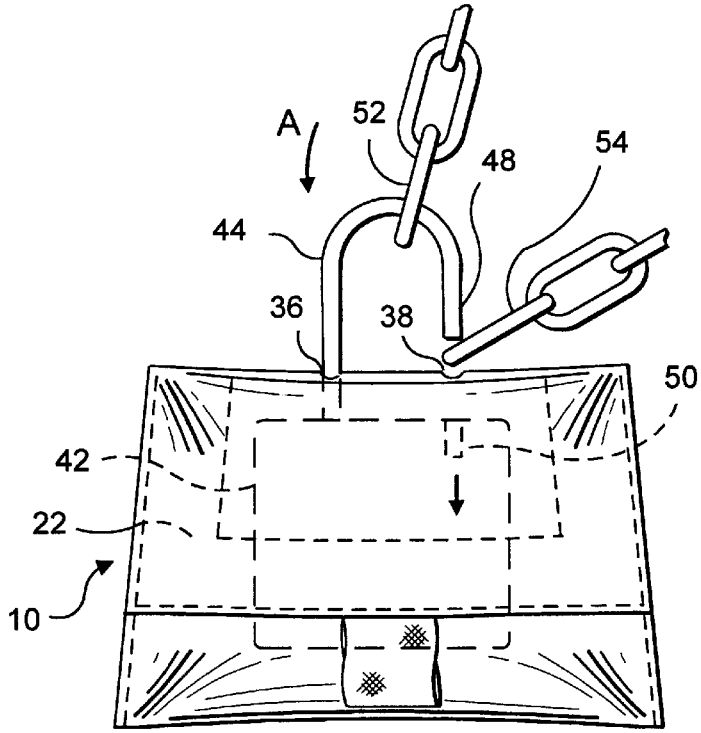
FIG. 4 shows the lock of FIG. 3 being nested in the protector with the shackle open.

Before the lock 40 is used, leg 48 is first inserted into one of the holes, such as hole 36, as seen in FIG. 3 while the flap 14 is held by the Tab A. Next, the protector 10 and the lock 40 are maneuvered so that the body 42 is disposed in pouch 22. Now the flap 14 is positioned over surface 28 and the strips 32, 34 are engaged thereby closing the pouch 22 to form a pocket. The protector 10 and the lock 40, with its shackle 42 still opened are shown in FIG. 4. It has been found by the present inventor that these steps can be performed fairly easily and rapidly even in the darkness, or with heavy mittens or work gloves on.

Figure 5:
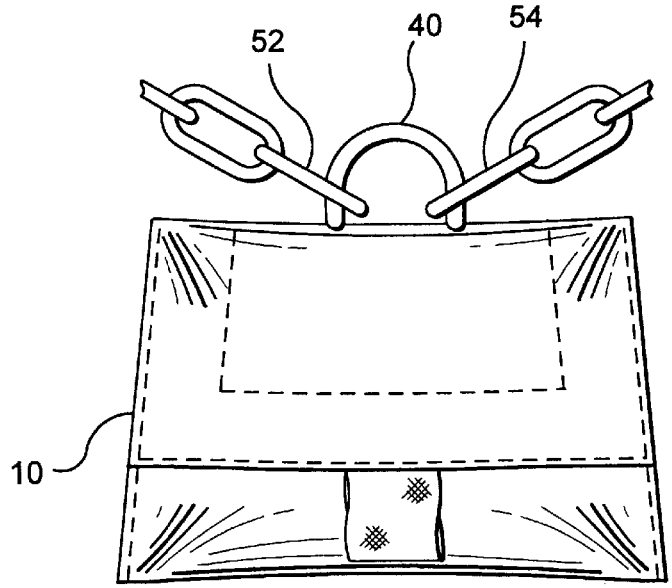
FIG. 5 shows the lock of FIG. 4 with the shackle closed.

Lock 40 is now ready to be used. In FIG. 4, the lock 40 is used for example to join two chain links 52, 54. These chain links may belong to the same chain or two different chains. For this purpose, the links 52, 54 are inserted on shackle 44 by passing them over free leg 48. Next, the shackle 44 is rotated so that the leg 48 is aligned with well 50. The shackle is now pressed toward body 42 as indicated by arrow A forcing the leg 48 through aperture 38 and into the well 50 until the leg 48 is locked to body 50. The final configuration of the protector 10, lock 40 and links 52, 54 are shown in FIG. 5. As can be seen in this Figure the lock 40 is resting with this body firmly secured in the pocket. Shackle 44 is exposed, however this is not important since the delicate mechanism of the lock 40 is disposed in the body 42, not in the shackle 44.

Preferably holes 36, 38 are made slightly smaller than the diameter of the shackle 44 so that they form a close interference therewith.

The protector 10 can be easily opened by pulling flap 14 away with Tab A.

The protector can be sized and shaped so that it can fit a large variety of locks, as long as the diameter of the shackle 44 and the distance between the legs 46, 48 is about the same.

The sheet 12 can be made from a variety of materials. Preferably the sheet is made of a flexible material such as natural or synthetic rubber. For example, the sheet may be made of butyl rubber which is advantageous because this material sticks to itself when folded thereby providing an air tight seal. The sheet may be about 0.078" thick. The inventor found that the protector can be cut and formed of a used inner tube of a truck tire. In fact a single inner tube can be used to make a large number of lock protectors as described above. Since other means of recycling inner tubes is quite expensive, this usage provides an attractive and environmentally friendly alternative. Automobile inner tubes can also be used for this purpose.

A preferred method of forming the protector is by sewing the sheet using a #46 polypropylene thread.

An important advantage of the inventor is that the pocket may also be used to hold small documents such as notes, messages, shipping labels, etc.

Obviously, numerous modifications may be made to this invention without departing from its scope as defined in the appended claims. For example, the protector need not be made of a single sheet, but instead may be made of a two or more sheets joined together. Similarly, instead of two round apertures for the shackle, a single extended aperture may be used.

I claim:

1. A protector for a lock formed of a lock body and a shackle having a first leg and a second leg, said protector comprising:

a flexible sheet having a first portion folded over to form a pouch and a second portion forming a flap for said pouch, said flap having a first and a second aperture for said first and second legs, respectively; and closing elements engaging said flap to said pouch to define a water tight pocket adapted to receive said body when said body is inserted into said pouch with said legs extending outwardly of said pouch through said apertures.

2. The protector of claim 1 wherein said first and second portions are joined along a line and wherein said apertures are positioned along said line.

3. The protector of claim 1 wherein said legs have a cross-sectional dimension and said apertures have a diameter smaller than said cross-sectional dimension to form an interference fit between said flap and said legs.

4. A protector for a lock, said lock having a body and a shackle attached to said body, said protector comprising:

a pouch arranged and constructed to hold said body; and a flap attached to said pouch and cooperating with said pouch to form a sealed pocket for said body, said flap being formed with an aperture being adapted to allow said shackle to extend from said sealed pocket through said aperture when said lock is inserted in said pocket, wherein said aperture is shaped to form an interference fit with said shackle.

5. A protector for a lock, said lock having a body and a U-shaped shackle having a first and a second leg attached to said body, said protector comprising:

a pouch arranged and constructed to hold said body; and a flap attached to said pouch and cooperating with said pouch to form a sealed pocket for said body, said flap being formed with a first aperture adpated to receive the first leg and a second aperture adapted to receive the second leg, said apertures being adapted to allow said shackle to extend from said sealed pocket through said apertures when said lock is inserted in said pocket.

6. The protector of claim 5 wherein said flap is attached to said pouch along a fold line, with said first and second apertures being formed along said fold line.

7. A protector for a lock, said lock having a body and a shackle attached to said body, said protector comprising:

a pouch arranged and constructed to hold said body; and a flap attached to said pouch and cooperating with said pouch to form a sealed pocket for said body, said flap being formed with an aperture being adapted to allow said shackle to extend from said sealed pocket through said aperture when said lock is inserted in said pocket;

wherein said pouch and said flap are made of rubber.

8. A lock assembly comprising:

a lock having a body and a U-shaped shackle attached to said body, said shackle being formed of a first and a second leg each having leg diameters;

a protector formed of a pouch arranged and constructed to hold said body and a flap cooperating with said pouch to form a protective pocket for said body when said body is disposed in said pouch, said protector having a first aperture for the first leg and a second aperture for the second leg, said apertures arranged so that when said body is in said pocket, said shackle extends outwardly of said pocket through said apertures.

9. The lock assembly of claim 8 wherein said apertures have aperture diameters, said aperture diameters being smaller than said leg diameters to form an interference fit between said protector and said shackle.

10. A lock assembly comprising:

a lock having a body and a shackle attached to said body, and a protector formed of a pouch arranged and constructed to hold said body and a flap cooperating with said pouch to form a protective pocket for said body when said body is disposed in said pouch, said protector having an aperture arranged so that when said body is in said pocket, said shackle extends outwardly of said pocket through said apertures, wherein said protector is made of rubber.

* * * * *